United States Patent [19]

Eheim

[11] 4,409,942

[45] Oct. 18, 1983

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 124,044

[22] Filed: Feb. 25, 1980

[30] Foreign Application Priority Data

Oct. 3, 1979 [DE] Fed. Rep. of Germany ..... 2909537

[51] Int. Cl.[3] ..... F02M 59/32; F02M 7/12

[52] U.S. Cl. ..... 123/387; 123/502; 123/199 L

[58] Field of Search ..... 123/366, 387, 385, 179 L, 123/502

[56] References Cited

U.S. PATENT DOCUMENTS

| | | | |
|---|---|---|---|
| 3,614,946 | 10/1971 | Staudt | 123/179 L |
| 4,170,976 | 10/1979 | Eckert | 123/387 |
| 4,214,564 | 7/1980 | Skinner | 123/179 L |
| 4,273,090 | 6/1981 | Höfer | 123/179 L |
| 4,278,058 | 7/1981 | Berner | 123/387 |

FOREIGN PATENT DOCUMENTS

| | | | |
|---|---|---|---|
| 238213 | 6/1945 | Switzerland | 123/387 |

*Primary Examiner*—Charles J. Myhre
*Assistant Examiner*—Carl Stuart Miller
*Attorney, Agent, or Firm*—Edwin E. Greigg

[57] ABSTRACT

The invention relates to a fuel injection pump having a hydraulic governor, wherein the control pressure is reducible via a valve operating in accordance with temperature when the engine is cold, as a result of which the idling rpm increases.

11 Claims, 3 Drawing Figures

FUEL INJECTION PUMP FOR INTERNAL COMBUSTION ENGINES

BACKGROUND OF THE INVENTION

The invention relates to a fuel injection pump in accordance with the preamble to the main claim. In a known fuel injection pump having a hydraulic governor of this type, a throttle is disposed between the pressure source and the adjusting piston which effects a predetermined pressure drop, and the pressure on the back of the adjusting piston is controlled by means of a valve exposed to pressure and controlled. A magnetic valve by way of which the chambers at either side of the throttle can be connected acts as the servomotor, with an increase in the injection quantity being effected after a connection has been established. The intention has accordingly been that with the adjusting lever in the same position (that is, given the same position of the gas pedal), but with the engine shifted into a lower gear, the engine speed will increase in order to attain increased torque, which is desirable in hill climbing, for instance, or in starting—in other words, whenever a lower gear has been selected. The pressure which acts upon the adjusting piston is thus increased in order to increase engine speed. This known governor is extremely complicated in design, and its complex hydraulic system is difficult to control. In addition, there is the danger, particularly if any of the slide valves jam, that with increasing engine speed and accordingly increasing hydraulic pressure, the injected fuel quantity will also increase, which can cause the engine to race.

OBJECT AND SUMMARY OF THE INVENTION

The fuel injection pump according to the invention and having the characteristics of the main claim has the advantage over the prior art of having a governor unit which is small yet of very precise quality. In addition, because of the basic design, there is the opportunity of reducing the control pressure by allowing a portion of the fuel to be discharged, thus attaining an increase in engine speed for a particular position of the adjusting lever. It is true that opening the channel will cause an increase in rpm; however, this is accomplished solely by displacing the control level as a whole. As soon as the rpm increase, the pressure increases as well, and downward control is instituted. Accordingly, opening a channel will not cause engine racing.

The invention will be better understood and further objects and advantages thereof will become more apparent from the ensuing detailed description of preferred embodiments taken in conjunction with the drawings.

DESCRIPTION OF THE PREFERRED EMBODIMENTS

Figures 1, 2:
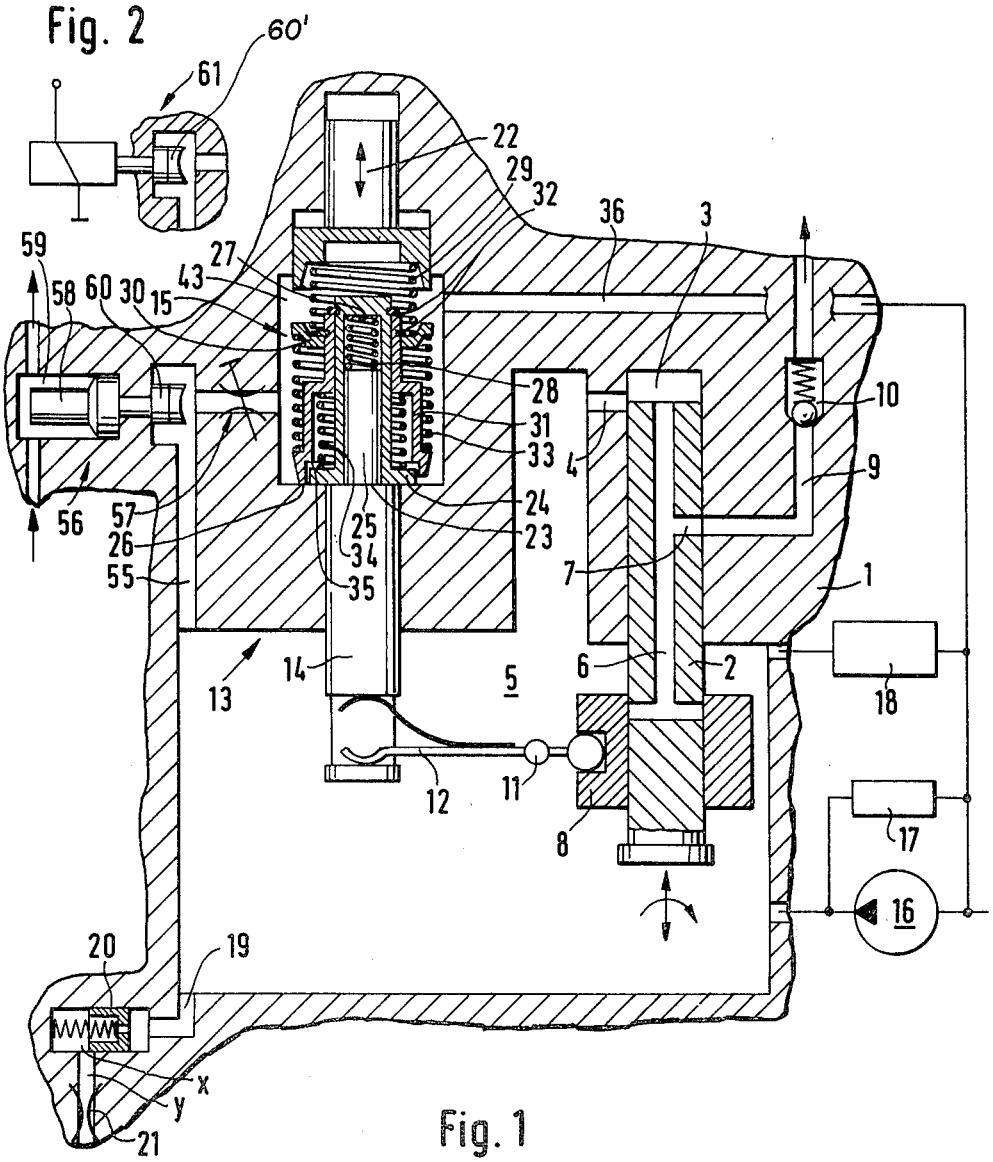
FIG. 1 shows the first exemplary embodiment in the form of a simplified representation of a fuel injection pump in lengthwise cross section.
FIG. 2 shows a schematic view of a magnetic valve for controlling fuel increase during idling.

Turning now to the drawings, in FIG. 1, a fuel injection pump according to the invention is shown in greatly simplified form. A pump piston 2, which is set into simultaneously reciprocal and rotary motion by a known cam drive mechanism, which is not shown, operates within a housing 1 The pump piston 2 defines within the housing 1 a pump work chamber 3, which communicates via an inlet channel 4 with the pump suction chamber 5 disposed on the housing 1. A pressure channel 6 discharging into the pump work chamber 3 is disposed in the pump piston 2 and a distributor bore 7 branches off from it. This pressure channel 6 is controlled by means of an annular slide 8 which acts as the fuel quantity control member. The distributor bore 7 cooperates with pressure lines 9, which are generally uniformly distributed about the pump piston and each of which contains a check valve 10. During the suction stroke of the pump, fuel proceeds out of the suction chamber 5 and through the inlet channel 4 into the pump work chamber 3. During the subsequent compression stroke of the pump piston 2, after the inlet channel 4 is closed, fuel proceeds at high pressure, via the distributor bore 7, to one of the pressure lines 9, in order to pass therethrough and through a fuel injection valve (not shown) into a cylinder of the internal combustion engine being supplied by the pump. After an appropriate compression stroke has been performed, the pressure channel 6 in the pump piston 2 is opened by the annular slide 8 in order to terminate injection, the channel 6 being opened by means of the emergence of a mouth of the pressure channel 6 from the annular slide 8 during the compression stroke.

The fuel injection quantity is thus dependent on the position of the annular slide 8, which is adjustable by means of a hydraulic governor 13 via a governor lever 12 supported at 11. The hydraulic governor 13 operates with an adjusting piston 14, one end face of which is exposed to the fuel from the suction chamber 5; acting counter thereto, a spring unit 15 engages the piston, its forces being variable arbitrarily. The suction chamber 5 receives the fuel from a supply pump 16, which is driven at a rotary speed synchronous with the engine (generally, it is integrated into the pump), with the pressure in the suction chamber 5 being controlled via a pressure control valve 17 in accordance with rpm; that is, the pressure increases with increasing rpm.

A piston of an injection time adjustment apparatus 18 is also under the influence of fuel from the suction chamber 5.

Branching off from the suction chamber 5 in the housing 1 is a discharge channel 19, in which an overflow valve 20 which acts as a constant-flow valve is disposed. In order to influence the control pressure, a throttle valve 21 can be added subsequent to this overflow valve 20. The functioning of the overflow valve 20 or of the subsequent throttle valve is as follows: The overflow quantity is controlled by means of the cross section x between the slide shaft and the bore y on the basis of the hydraulic balance—that is, the ratio of pressure times the front slide surface area to the reduced pressure on the rear slide surface times the slide surface area plus the spring force.

The spring unit 15 is arranged to act counter to the hydraulic force that engages the piston 14 and may comprise one spring or a plurality of springs, which cooperate via spring plates and are made to act in sequence in an advantageous manner. In each case, the force of at least one of the springs can be varied by means of a coupler member 22, which is embodied here in the form of a piston, disposed coaxially with the actual adjusting piston in the housing 1, and which is axially adjustable from outside the pump housing 1 by means of an adjusting lever (not shown). Upon removal of the coupler member 22, the spring unit 15 can be separated from the adjusting piston 14 in a very simple manner and then exchanged for another spring unit; that is, with the same fundamental embodiment, different spring units can be used. The adjusting piston 14 has a step or shelf area 23, which serves as a contact surface for a flanged sleeve 24, said flange providing a spring support plate, said flanged sleeve arranged to be placed over the reduced-diameter or stub portion 25 of the adjusting piston 14. The flanged sleeve 24 has its portion supported at 26 on the housing 1. A starting spring 28 is disposed between the base 27 of the sleeve 24 and the end face of the stub portion 25. When the engine stops, the starting spring 28 displaces the adjusting piston 14 and thus the stub portion 25 a predetermined distance out of the sleeve 24, as a result of which the annular slide 8 of the injection pump is in turn displaced (upward in the drawing) to such an extent that the mouth of the pressure channel 6 no longer emerges from the annular slide 8; thus the entire fuel quantity supplied by the fuel injection pump is injected as a starting quantity. Then, as soon as the engine has started, and a predetermined pressure has been established in the suction chamber 5 via the supply pump 16, the adjusting piston 14 is displaced against the starting spring 28, until the step 23 strikes the sleeve 24; with respect to the position of the annular slide 8, this corresponds to full load.

The idling rpm is governed by means of an idling spring 29, which is supported on one end on the coupler member or piston 22 and on the other end on an intermediately disposed spring plate 30, which is supported in axially displaceable fashion in the direction of the force of the spring 29 on a spring plate bushing 31, which is likewise disposed in axially displaceable fashion in the same direction on the sleeve 24. The freedom of motion in the opposite direction is prevented in each case by a securing ring 32 disposed on the sleeve 24 or more specifically in a recess provided in said sleeve 24 and against which the spring plate bushing 31 is arranged to abut. A governor spring 33 engages the side of the intermediate spring plate 30 remote from the idling spring 29 and is supported on the other end on a shelf area provided on the spring plate bushing 31. An adjustment spring 34 is disposed between the spring plate bushing 31 and the spring plate sleeve 24, with the travel path of the sleeve 24—that is, the variation of the force of the adjustment spring 34—being limited by a flange or shoulder 35 provided on the spring plate bushing 31.

The governor functions as follows: After starting of the engine and compression of the starting spring 28, and as long as the piston or coupler member 22 is in the idling position corresponding to idling rpm, the adjusting piston 14, which includes the spring unit 15, is displaced upward and toward the coupler member or piston 22 by the fuel pressure in the suction chamber 5. At the same time, the annular slide 8 is displaced in a downward direction until the injection quantity effects an idling rpm which is governed by means of a remnant spring travel path of the idling spring 29 which has a degree of irregularity which is as low as possible. In FIG. 1, the adjusting piston 14 is in the position shown in the drawing after starting, but before the displacement into the idling position. In contrast, the coupler member 22 is displaced out of the idling position downwardly, in the direction of the adjusting piston 14. That is, as soon as the adjusting piston 14 with the spring packet 15 has been displaced upward when there is sufficient pressure in the suction chamber 5, idling is no longer attained; instead, a fuel injection quantity is effected which corresponds to partial load. Now, as soon as the load on the engine decreases, the rpm and thus the pressure in the suction chamber 5 increases, and the adjusting piston 14 displaces the sleeve 24 and the spring plate bushing 31 upward against the force of the governor spring 33, which then causes a downward control of the fuel injection quantity. Depending upon how the piston or coupler member 22 is displaced by the gas pedal, a different fuel injection quantity is thus established. For example, after exceeding the maximum permissible rpm, the spring 33 is compressed and a downward control of the fuel supply is effected accordingly. In FIG. 1, the spring unit 15 assumes the position for full load—that is, a position which is assumed during operation of the engine whenever it is brought about by means of the coupler member 22 when it is pushed against the spring plate 30 (full load position). This governor thus functions as an idling end governor, that is, a governor which governs solely the idling or final rpm. In the intermediate-load positions, the injection quantity is determined by the driver of the vehicle equipped with an engine equipped with this device. In the example shown in FIG. 1, the spring plate bushing 31 is supported in the full-load position in the left-hand half of the housing 1 as shown at 26, so that the adaptation spring 34 can be effective over the entire arbitrary adjustment range, and in particular at full load. That is, at full load, even when the spring plate bushing 31 is resting against the housing, the cap 24 can travel the distance of an adjustment path before downward control occurs as a result of compression of the governor spring 33. In contrast to this, the spring plate bushing 31 is not in contact with the housing in the right-hand half of the illustrated governor; instead, it is held in the illustrated position by the adjustment spring 34. However, as soon as the coupler member 22 is displaced into the full-load position, that is, directly engages the spring plate 30 of the governor spring 33, the spring plate bushing 31 is pushed with its shoulder 35 against the crimped portion of the cap 24, whereupon the adjustment spring 34 is correspondingly compressed. Thus, no adjustment is possible at full load. Over the entire partial-load range, the situation is otherwise; that is, the spring plate bushing 31 assumes the illustrated position with respect to the cap 24, or some intermediate position corresponding to the adjustment at that time. The advantage over the governor embodiment shown in the left-hand half of the figure is, in particular, that the adjustment is precluded along the natural hydraulic full-load line.

The chamber which encloses the spring unit 15, into which the coupler member 22 protrudes on one end and the adjusting piston 14 protrudes on the other end, is relieved of pressure toward the suction side of the pump via a channel 36. In the governor according to the invention, the principle of balance between the hydraulic pressure on the side and the spring forces on the other side is optimally attained by means of the favorable structural arrangement and the small structural space required. In accordance with the invention, the spring unit 15 can also be so embodied that the governor functions as an adjustment governor; that is, that a certain rpm of the engine corresponds to every position of the coupler member 22.

In order to obtain smooth running of the engine while it is still cold, it may be necessary to increase the injection quantity during idling. An increase of the idling quantity of this kind can be effected as follows: As long as the engine is still cold, the pressure in the suction chamber 5 is reduced slightly, as a result of which the adjusting piston 14 remains displaced somewhat lower by means of the idling spring 29; accordingly the annular slide 8 effects a correspondingly greater injection quantity. As shown in FIG. 1, a reduction of this kind in the pressure in the suction chamber 5 can be effected by permitting a discharge of a partial fuel quantity. This partial quantity flows out via a channel 55, which is controlled by a thermal controlled valve 56 and by a throttle valve 57 in series therewith. The discharge channel 55 empties into the spring chamber 43, which is relieved of pressure via the relief channel 36. The throttle valve 57 is initially adjusted to correspond to the maximum permissible discharge quantity. The thermal controlled valve 56 operates with an expansible-substance governor 58, which is controlled by way of the engine coolant, which in turn is caused to flow to and around the expansible-substance governor 58 by way of a system of channels 59. As soon as the engine temperature increases, the expansible-substance governor 58 effects a displacement of the movable valve member 60 and thus a reduction in or termination of the discharge of fuel. The quantity of fuel flowing out—that is, the additionally injected fuel quantity in the case of a cold engine—decreases uniformly as the temperature increases.

In FIG. 2, a corresponding control of the discharge quantity is shown for the purpose of increasing the idling fuel quantity in the case of a cold engine. Here, a magnetic valve 61 is used instead of a thermally controlled valve 56. The magnetic valve 61 is controlled from the standpoint of the engine; as soon as the appropriate engine temperature has been attained, the movable valve element 60' blocks off the discharge channel 55.

An increase of the idling rpm when the engine is cold, which is shown by way of example in FIGS. 1 and 2, can also be combined with a corresponding adjustment of the injection time adjuster. The injection time adjuster is advantageously displaced toward "early" when the engine is cold, so as to permit sufficient time for preparation of the fuel in the combustion chamber.

Figure 3:
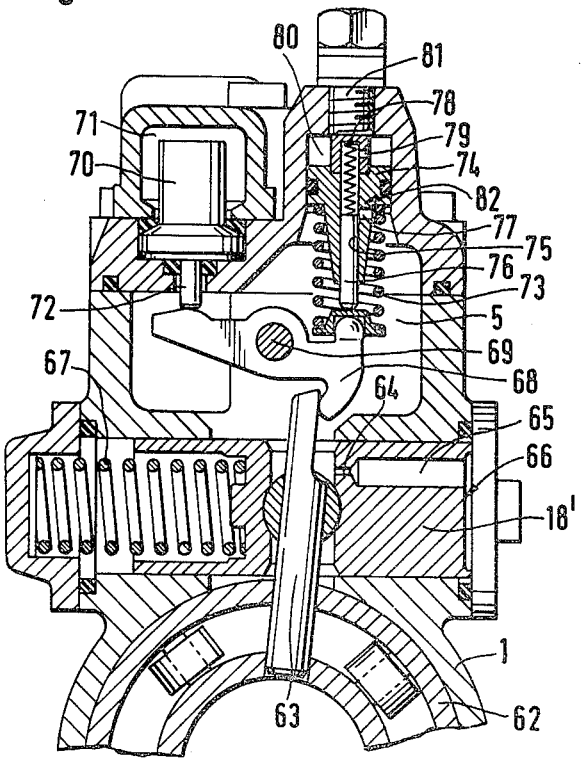
FIG. 3 is a structural representation of the second exemplary embodiment, showing the combination of the idling increase with an adjustment toward "early" for cold starting being made by the injection onset adjuster.

In FIG. 3, a combination of this kind is shown. In the housing 1 of the fuel injection pump, in addition to what was shown in FIG. 1, a ball bearing 62 is rotatably supported, as a result of which a cam disc (not shown), which is coupled with the pump piston of the injection pump 2, is set into reciprocal motion. The cam disc is directly driven to rotate by means of the drive shaft of the injection pump. A bolt 63 is connected to the ball bearing 62 and is actuated by means of an injection time adjusting piston 18'. Fuel proceeds from the suction chamber 5, via a damping throttle 64 and a bore 65 which are each disposed in the piston 18', to the end face 66 of the adjusting piston 18 and displaces it against the force of a restoring spring 67. As a result it is attained that the onset of the injection instant is varied in accordance with the rpm. This adjustment is initially set on the basis of an engine at normal operating temperature. When the engine is cold, however, the onset of injection should be adjusted in the lower rpm range toward "early" so as to give the fuel sufficient time for preparation. In order to attain this adjustment toward "early", a stop lever 68 engages the bolt 63 on the side remote from the ball bearing 62. This stop lever 68 is pivotally supported at 69 and is adjustable via an expansible-substance governor 70. The expansible-substance governor 70, in turn, is controlled by means of the engine coolant, which is directed to flow about the expansible-substance governor 70 in the chamber 71. The position of the stop lever 68 corresponds to a warm engine, and it is for this reason that the injection time adjusting piston 18' can assumes its outset position. In contrast, when the engine is cold, the control element 72 of the expansible-substance governor 70 is retracted, so that the stop lever 68 displaces the bolt 63 toward the left, which corresponds to an shift of the injection onset toward "early". In order to bring about a force-locking connection between the stop lever 68 and the control element 72, the stop lever 68 is stressed by a spring 73, which acts upon the appropriate end of the stop lever 68. This spring 73 is supported, on the end remote from the lever 68, on a piston 74 guided by the housing and having a central bore 75 for the purpose of receiving a valve slide 76. A radial bore 77 which communicates with the suction chamber 5 discharges into the central bore 75 and is controlled by means of the end face of the valve slide 76. The valve slide 76 is actuated against the force of a restoring spring 78 by means of the stop lever 68. Depending upon the temperature of the engine—that is, depending upon the position of the valve slide 76—a larger or smaller quantity of fuel flows out of the suction chamber 5 into the central bore 75 and thence, via a throttle bore 79, into a pressure-relieved chamber 80 above the piston 74. The piston 74 and thus the control cross section at 82 between the radial bore 77 and the valve slide 76 can be initially set by means of an adjusting screw 81. As a result of this embodiment of the invention, it is possible first that, as described in greater detail in connection with FIG. 1, an increase in the idling rpm is attained in the cold engine by means of reducing the pressure in the suction chamber 5; and simultaneously, in the cold engine, the injection time adjuster is displaced toward "early", although the reduction of the pressure in the suction chamber 5 would normally lead one to expect an adjustment toward "late" from the standpoint of the hydraulic displacement of the injection time adjuster.

An additional opportunity for introducing a control variable for load dependency into the control circuit is presented in the exemplary embodiment shown in FIG. 2. Here, a portion of the fuel located in the suction chamber 5 flows out under load-dependent control because the magnet is driven in accordance with load. As a result, the pressure correspondingly varies in accordance with load, which causes on the one hand a corresponding variation of the pressure which acts upon the adjusting piston 14 and on the other hand a variation in the control variable of the piston 18.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for an internal combustion engine, said fuel pump including a fuel supply pump which is driven at an rpm synchronous with engine speed to supply operating fuel to a suction chamber in said fuel injection pump, a fuel pump piston which is set into simultaneous reciprocal and rotary motion by a cam drive means, an annular slide fuel quantity control member operable on said fuel pump piston for determining a fuel injection quantity, a hydraulic rpm governor, said hydraulic rpm governor including an adjusting piston, one end of said adjusting piston projecting into a pressure relieved chamber and the other end projecting into said suction chamber in said fuel injection pump, a governor lever supported in said combustion chamber for adjustable operation of said annular slide in an axial direction relative to said fuel pump piston, said governor lever being operable by said hydraulic rpm governor adjusting piston, spring means in said pressure relieved chamber surrounding said adjusting piston which operates counter to fuel pressure in said fuel injection pump on an end of said adjusting piston, a fuel discharge channel connected with said suction chamber and said pressure relieved chamber which relieves pressure in said suction chamber, a valve operable to control fuel flow through said fuel discharge channel to control pressure in said suction chamber, a servomotor for operating said valve in accordance with the operating temperature of said engine, characterized in that said valve is under the influence of said servomotor and arranged to be held open when said engine is cold at which time the pressure in said suction chamber is accordingly lower and the injection quantity is greater, and when the engine is warm and/or hot said valve is held in a closed position, and an adjustable throttle in said fuel discharge channel which normally restricts flow in said fuel discharge channel when said valve is in an open position.

2. A fuel injection pump for an internal combustion engine as claimed in claim 1 which includes:

a second fuel discharge channel connected to said suction chamber, said second discharge channel including an overflow valve therein which regulates fuel flow from said suction chamber in accordance with pressure, the greater the pressure in said suction chamber the less the cross section controlled by said overflow valve in said second discharge channel.

3. A fuel injection pump in accordance with claim 1, characterized in that the flow-through cross section of said valve is controlled in accordance with the temperature.

4. A fuel injection pump in accordance with claim 1, characterized in that said engine coolant acts as the temperature carrier medium.

5. A fuel injection pump in accordance with claim 1, characterized in that said servomotor is electrically operated.

6. A fuel injection pump in accordance with claim 1, characterized in that an expansible-substance acts as said servomotor of said valve.

7. A fuel injection pump in accordance with claim 1, characterized in that a bimetallic element acts as said servomotor of said valve.

8. A fuel injection pump in accordance with claim 1, characterized in that said servomotor includes a magnet.

9. A fuel injection pump in accordance with claim 1, characterized in that said channel discharges into the pressure-relieved spring chamber.

10. A fuel injection pump in accordance with claim 1, characterized in that said fuel injection pump has an apparatus for the rpm-dependent adjustment of the injection time, whereupon operation of this apparatus the onset of injection is adjustable toward "early" when the engine is cold, said operation being effected by means of said servomotor.

11. A fuel injection pump in accordance with claim 10, characterized in that another servomotor actuates a further movable valve element via a lever, which additionally engages the injection time adjustment apparatus.

* * * * *